US011129435B2

(12) United States Patent
Feng et al.

(10) Patent No.: US 11,129,435 B2
(45) **Date of Patent: *Sep. 28, 2021**

(54) ALL WEATHER CYCLING SHOE COVER

(71) Applicant: Rivet Sports, LLC, Santa Rosa, CA (US)

(72) Inventors: Zhen Zhou Feng, Santa Rosa, CA (US); Thomas N. Buckley, Narrabri (AU); Zhen-Yu Feng, Kuala Lampour (MY)

(73) Assignee: Rivet Sports, LLC, Santa Rosa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,292

(22) Filed: Aug. 30, 2018

(65) Prior Publication Data

US 2018/0368507 A1 Dec. 27, 2018

Related U.S. Application Data

(63) Continuation of application No. 14/759,720, filed as application No. PCT/US2014/012054 on Jan. 17, 2014, now Pat. No. 10,104,930.

(Continued)

(51) Int. Cl.

| | |
|---|---|
| ***A43B 3/16*** | (2006.01) |
| ***A43B 5/14*** | (2006.01) |

(Continued)

(52) U.S. Cl.

CPC ..... *A43B 3/16* (2013.01); *A43B 5/14* (2013.01); *A43B 5/18* (2013.01); *A43B 7/12* (2013.01)

(58) Field of Classification Search

CPC .. A43B 3/16; A43B 3/166; A43B 5/14; A43B 5/18; A43B 7/12; A41B 11/10;

(Continued)

(56) References Cited

U.S. PATENT DOCUMENTS 1,518,758 A * 12/1924 Rodee ..... A41B 11/08 2/61
1,543,353 A * 6/1925 Wolff ..... A41B 11/08 2/61

(Continued)

FOREIGN PATENT DOCUMENTS

| | | |
|---|---|---|
| CN | 101721004 A | 6/2010 |
| RU | 2306118 C2 | 9/2007 |
| RU | 108961 U1 | 10/2011 |

*Primary Examiner* — Heather Mangine

(74) *Attorney, Agent, or Firm* — Dascenzo Gates Intellectual Property Law, P.C.

(57) ABSTRACT

Shoe covers that include a waterproof sock shaped unitary tubular member. The shoe covers are configured to cover footwear having a sole with a bottom. The member includes a first waterproof tubular portion that has an upper opening configured to receive an ankle and a heel of a foot of a person when the footwear and shoe cover are donned. The member further includes a second waterproof tubular portion that has a bottom surface and is configured to correspond to and seal against the bottom of the sole of the footwear when the member is donned on the footwear. The bottom surface of the second waterproof tubular portion defines an opening. When the footwear is cycling footwear that includes a cleat projecting from the bottom, the opening may be configured to receive the cleat of the cycling footwear. Methods of donning and manufacturing the shoe covers also are disclosed.

20 Claims, 17 Drawing Sheets

Related U.S. Application Data

(60) Provisional application No. 61/754,534, filed on Jan. 19, 2013.

(51) Int. Cl.
*A43B 5/18* (2006.01)
*A43B 7/12* (2006.01)

(58) Field of Classification Search
CPC ..... A41B 11/08; A41D 13/06; A41D 17/00; A61F 15/004; A61F 13/043
USPC ..... 2/239, 61; 602/3; 36/7.1 R, 7.2, 7.4, 7.3
See application file for complete search history.

(56) References Cited

U.S. PATENT DOCUMENTS 1,792,539 A 2/1931 Huntman et al.
2,015,648 A * 9/1935 Gammeter ..... B29C 41/14 156/184
2,032,793 A * 3/1936 Clark ..... A43B 5/18 36/7.4
2,033,626 A * 3/1936 Gammeter ..... B29C 41/14 2/242
2,109,134 A 2/1938 Kendrick
2,109,566 A * 3/1938 Fischer ..... A43B 5/1666 280/811
2,117,417 A 5/1938 Hall et al.
2,171,654 A * 9/1939 Hinchliff ..... A43B 3/20 36/72 R
3,359,658 A * 12/1967 Price ..... A43B 3/163 36/7.1 R
3,373,510 A * 3/1968 Memole ..... A43B 3/0078 36/100
3,875,687 A 4/1975 Henderson
4,043,326 A * 8/1977 Little ..... A61F 15/004 602/3
4,069,600 A * 1/1978 Wise ..... A43B 19/00 2/22
4,094,312 A * 6/1978 Whyte ..... A61F 13/043 602/10
4,204,345 A * 5/1980 Bradley ..... A43B 5/0409 36/10
4,445,287 A * 5/1984 Garcia ..... A43B 5/18 36/106
4,604,816 A * 8/1986 Davison ..... A43B 5/18 36/1.5
5,211,672 A * 5/1993 Andujar ..... A43B 5/00 36/106
5,412,957 A * 5/1995 Bradberry ..... A61F 13/08 2/239
5,579,539 A 12/1996 Flick
5,598,584 A 2/1997 Da Grossa
5,682,617 A * 11/1997 Tumas ..... A41B 11/00 2/239
5,728,052 A * 3/1998 Meehan ..... A61F 13/041 602/3
5,737,943 A * 4/1998 Bernhardt ..... A41B 11/00 2/239
5,953,756 A 9/1999 Vrissimdjis
6,047,403 A * 4/2000 Juozaitis ..... A61F 13/043 2/239
6,249,917 B1 6/2001 Vrissimdjis et al.
6,276,364 B1 8/2001 Warner
6,916,301 B1 * 7/2005 Clare ..... A61F 15/004 128/856
7,448,091 B2 11/2008 Kruss
7,533,424 B2 * 5/2009 Symonds-Powell ... A41B 11/00 2/239
7,682,326 B2 * 3/2010 Song ..... A43B 5/00 2/239
8,701,310 B1 * 4/2014 Walsh ..... A43B 3/16 36/7.2
2002/0066208 A1 * 6/2002 Hall ..... A43B 3/0078 36/7.3
2003/0046748 A1 * 3/2003 Tanenbaum ..... A41D 19/0089 2/209.13
2003/0154625 A1 * 8/2003 Royle ..... A01K 13/007 36/7.3
2004/0200097 A1 * 10/2004 Boyd ..... A43B 3/0078 36/96
2004/0262546 A1 12/2004 Thiess et al.
2005/0229287 A1 10/2005 Mattesky
2006/0101671 A1 * 5/2006 Berend ..... A43B 3/24 36/100
2008/0052957 A1 * 3/2008 Taheri ..... A43B 3/106 36/7.1 R
2008/0092261 A1 4/2008 Yu et al.
2008/0092275 A1 * 4/2008 Wei ..... A41B 11/08 2/242
2008/0250666 A1 * 10/2008 Votolato ..... A43B 3/16 36/7.1 R
2009/0071037 A1 3/2009 Foxen et al.
2009/0083993 A1 * 4/2009 Plank ..... A43B 3/0078 36/7.3
2010/0107440 A1 * 5/2010 Sansone ..... A43B 3/166 36/7.1 R
2010/0234781 A1 * 9/2010 Cassidy ..... A61F 5/01 602/3
2010/0301632 A1 * 12/2010 Bryne ..... A43B 5/14 296/180.1
2011/0023215 A1 * 2/2011 Obradovic ..... A43B 3/16 2/239
2011/0252581 A1 * 10/2011 Teichert ..... A43B 3/16 12/146 R
2011/0265233 A1 * 11/2011 Shiue ..... A41D 13/012 2/2.15
2012/0198595 A1 * 8/2012 Young ..... A41D 17/00 2/69
2013/0263468 A1 * 10/2013 Ciccarelli ..... A43B 3/16 36/7.1 R
2015/0113831 A1 * 4/2015 Weingart ..... A43B 3/16 36/87
2015/0189940 A1 * 7/2015 Teichert ..... A43B 3/16 36/72 R
2018/0168274 A1 * 6/2018 Dickson ..... A43B 5/18

* cited by examiner

FIG. 3C
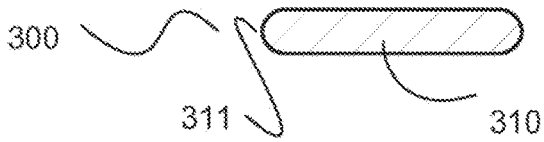
FIG. 3B
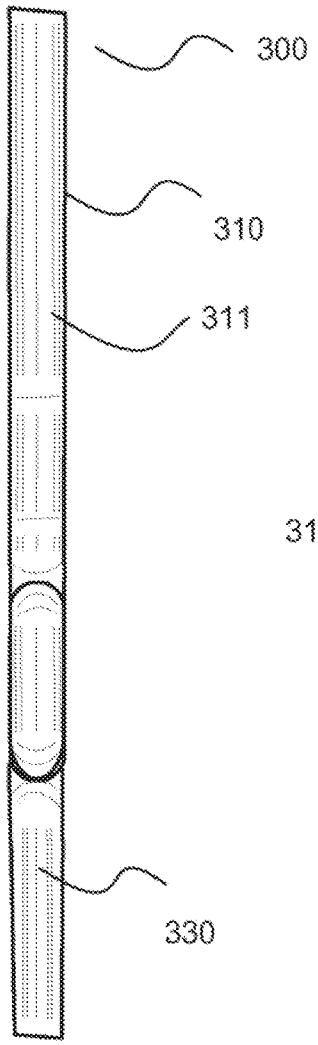
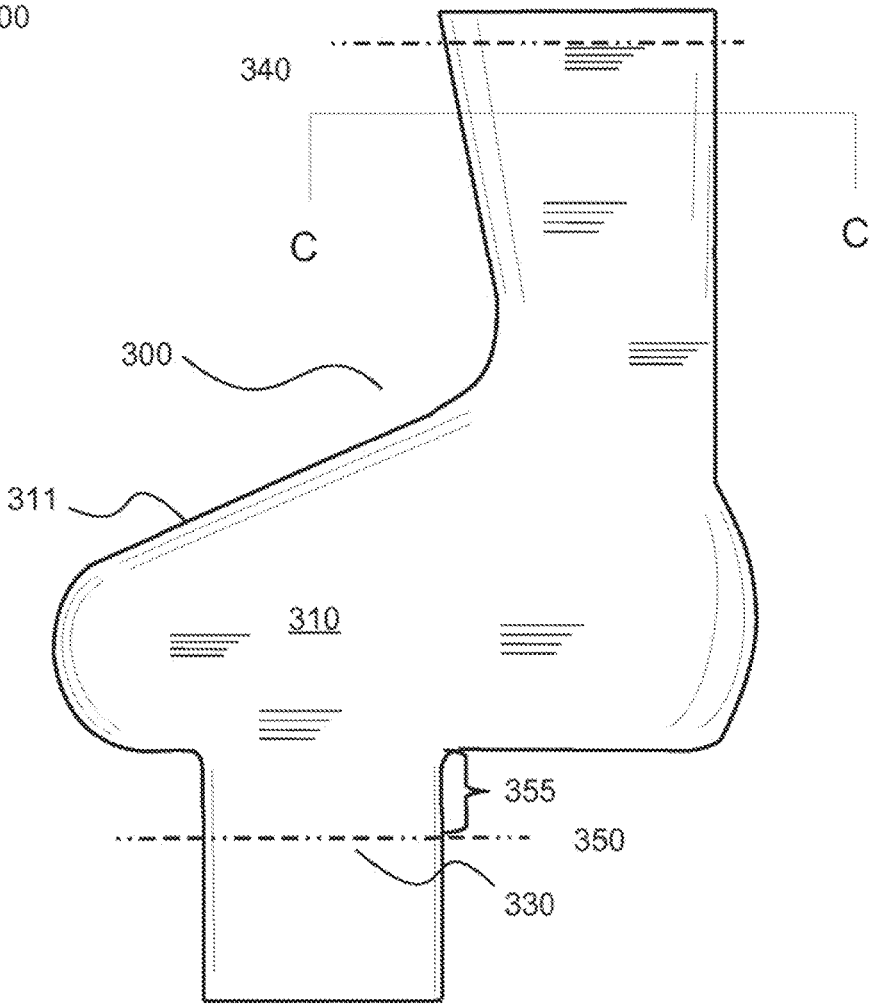
Dimensions in mm
FIG. 3A

FIG. 6C
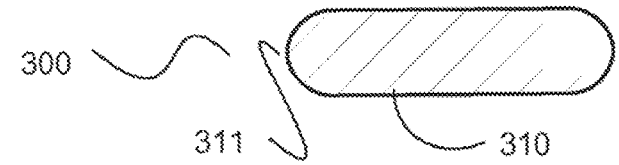
FIG. 6B
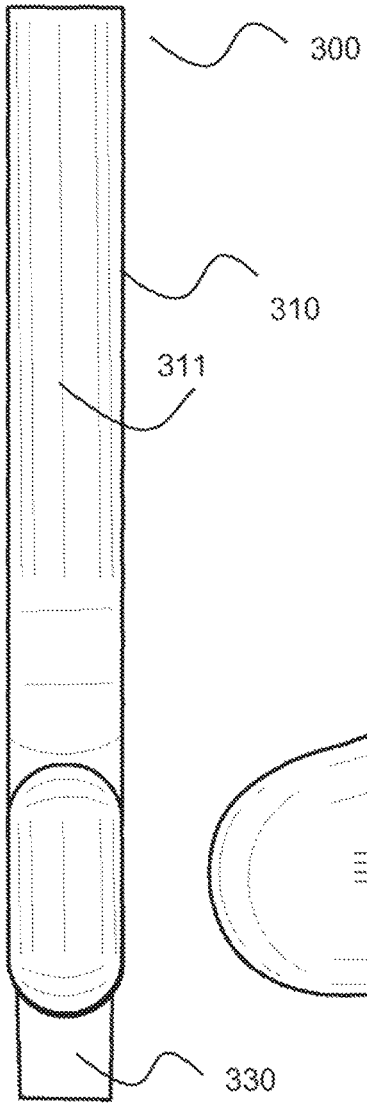
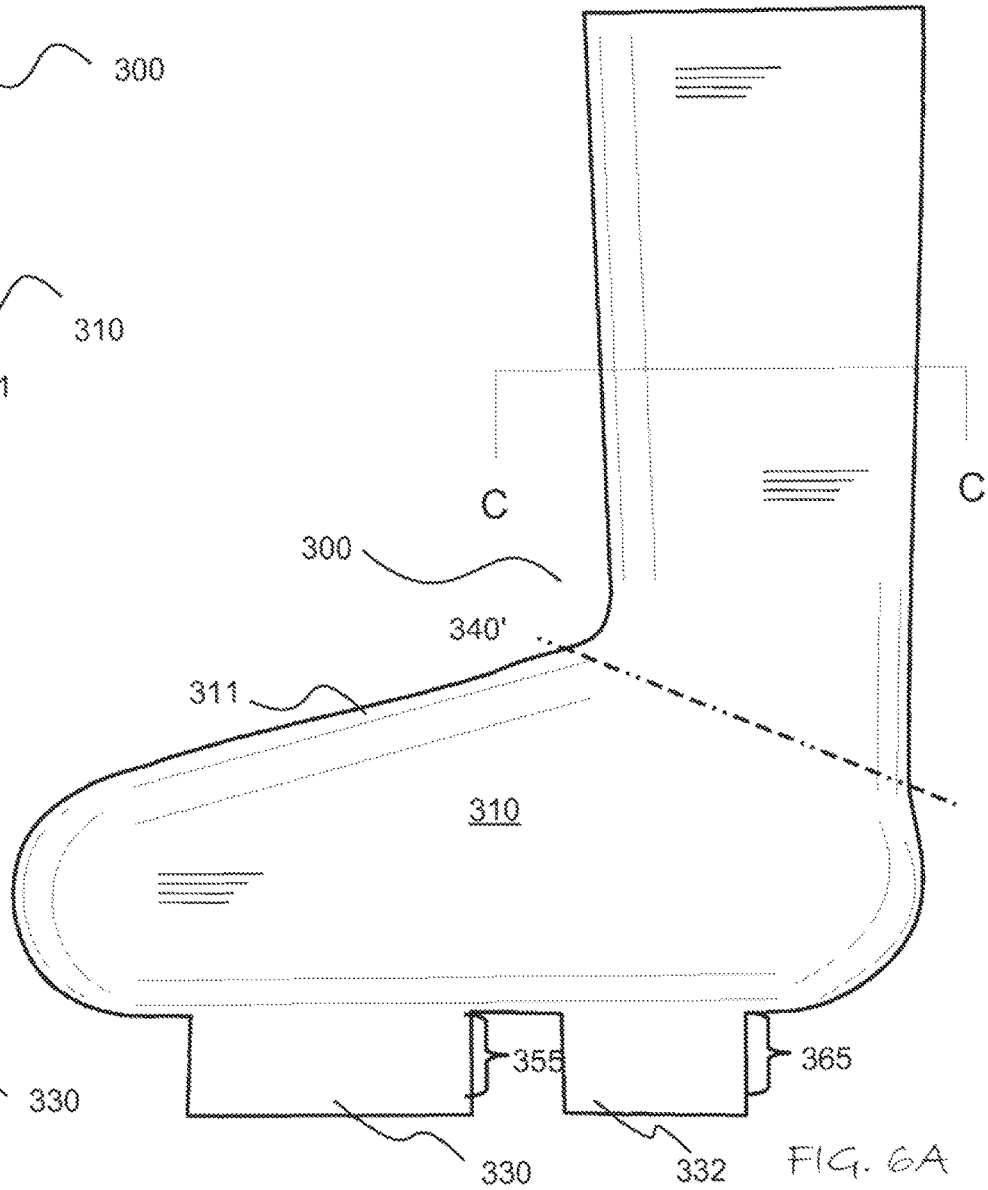
FIG. 6A

D
H
100

115
161
160
110
121
122
120
118
125
118
126
101

FIG. 11C
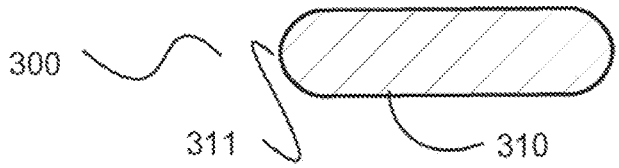
FIG. 11B
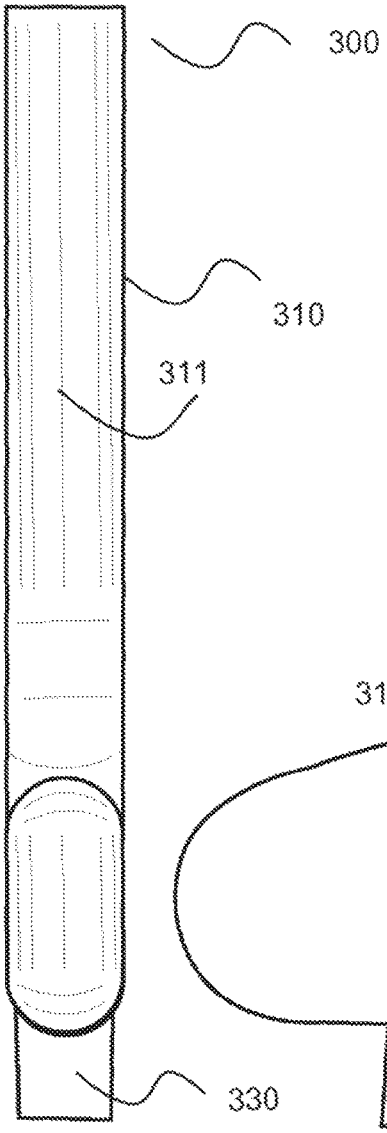
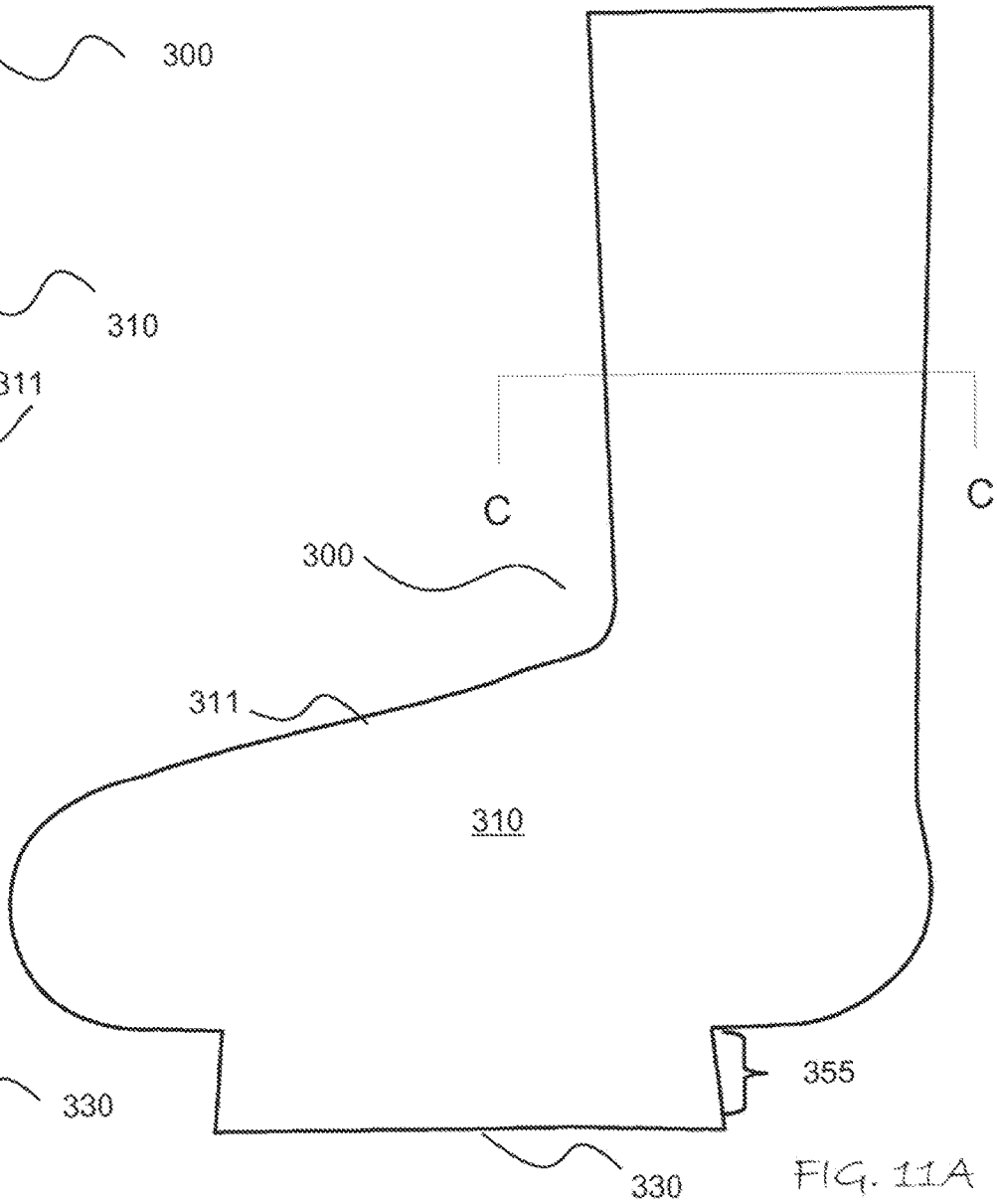
FIG. 11A

ALL WEATHER CYCLING SHOE COVER

CROSS REFERENCE TO RELATED APPLICATIONS

This application is a continuation patent application that claims priority under 35 U.S.C. § 120 to U.S. patent application Ser. No. 14/759,720, which was filed on Jul. 8, 2015 and is a U.S. national-phase patent application under 35 U.S.C. § 371 of PCT International Patent Application No. PCT/US2014/012054, which was filed on Jan. 17, 2014 and claims priority under 35 U.S.C. § 119 to U.S. Provisional Patent Application No. 61/754,534, which was filed on Jan. 19, 2013. The entire disclosures of these related patent applications are incorporated herein by reference.

BACKGROUND OF INVENTION

The field of invention is protective covers for shoes or footwear, and more particularly bicycle shoes such as those used in competitive bicycle racing and the practice thereof.

Currently, most avid cyclists wear cycling shoes with cleats attached to the bottom of the shoes, which allow firm and secure contact with cycling pedals. Prior art shoe covers are intended to keep the feet of the cyclist dry in inclement weather, or when splashes from puddles and mud may hit the cyclist. Such shoe covers protect a portion of the shoe to some extent, but do not really keep the cyclist's feet dry. Further, such prior art or current cycling shoe covers are typically made from sheets of foamed and elastic fabric covered or filled NEOPRENE® brand rubber or LYCRA® or "Spandex" brand fabric materials, which are heavy or can lose water resistance after prolonged exposure to rain and snow. Most of these shoe covers are designed to slip over the shoe from below, a "bottom-up" installation process, and are secured with a zipper or VELCRO® brand hook and loop fasteners along a seam at the back or side of the foot and ankle. These covers are made by the attachment of multiple precut fabric pieces, which creates multiples seams, allowing water to egress through the seams.

The third and most important weakness of the bottom-up design is that the seal around the ankle cannot be made sufficiently snug to prevent substantial water egress from above. The fourth weakness is that the bottom-up design is costly to produce, because of the materials, the attachment of multiple precut pieces of these materials to each other, and the formation of these seams and, as well as the attachment of stays or fasteners.

Accordingly, it is an object of the invention to provide a new and improved cycling shoe cover that overcomes the above deficiencies of the prior art.

It is a further object to provide such a shoe cover that can be made at significantly reduced costs.

The above and other objects, effects, features, and advantages of the present invention will become more apparent from the following description of the embodiments thereof taken in conjunction with the accompanying drawings.

SUMMARY OF INVENTION

The present disclosure is directed to waterproof shoe covers. The shoe covers include a waterproof sock shaped unitary tubular member that is formed from an elastic waterproof material. The shoe covers are configured to cover footwear having a sole with a bottom. The footwear may be cycling footwear, which may include a cleat that projects from bottom of the sole. The waterproof sock shaped unitary tubular member includes a first waterproof tubular portion that has an upper opening defined at a proximal end of the first waterproof tubular portion, and a distal end opposite the proximal end. The upper opening is configured to receive an ankle and a heel of a foot of a person therethrough when the footwear and shoe cover are donned. The waterproof sock shaped unitary tubular member further includes a second waterproof tubular portion that is closed at a second tubular portion distal end and which is connected in waterproof sealed unitary engagement at a second tubular portion proximal end to the distal end of the first waterproof tubular portion. The second waterproof tubular portion has a bottom surface and is configured to correspond to and seal against the bottom of the sole of the footwear when the waterproof sock shaped unitary tubular member is donned on the footwear. The bottom surface of the second waterproof tubular portion defines an opening. When the waterproof sock shaped unitary tubular member is donned on footwear, the bottom surface of the second waterproof tubular member may extend interior of an edge of the bottom of the sole by at least 1 cm and/or the opening may be spaced inward from the edge by at least 1 cm.

When the footwear is cycling footwear that includes the cleat, the opening may be configured to receive therethrough the cleat of the cycling footwear when the waterproof sock shaped unitary tubular member is donned on the cycling footwear. In such embodiments, the bottom opening may not contact the cleat when the waterproof sock shaped unitary tubular member is donned on the cycling footwear. In some embodiments, the waterproof sock shaped unitary tubular member further includes a second opening in the bottom surface of the second waterproof tubular portion. The second opening may be spaced apart from the other (first) bottom opening. Methods for donning the shoe covers also are disclosed.

The above and other objects, effects, features, and advantages of the present invention will become more apparent from the following description of the embodiments thereof taken in conjunction with the accompanying drawings.

BRIEF DESCRIPTION OF DRAWINGS

FIG. 1A is a top plan view of a first embodiment of the inventive shoe cover disposed in a relaxed configuration on a flat surface, whereas FIG. 1B is a cross-sectional elevation of the portion indicated by section line B-B in FIG. 1A.

FIG. 3A is a side elevation view of a mold used to form the shoe cover of FIGS. 1 and 2, whereas FIG. 3B is a front elevation view thereof and FIG. 3C is a cross-sectional elevation at section line C-C in FIG. 3A.

FIG. 6A is a side elevation view of a mold used to form the shoe cover of FIGS. 4 and 5, whereas FIG. 6B is a front elevation view thereof and FIG. 6C is a cross-sectional elevation at section line C-C in FIG. 6A.

FIG. 9A is a top plan view of another embodiment of the inventive shoe cover disposed in a relaxed configuration on a flat surface, whereas FIG. 9B is an enlarged cross-sectional elevation of the highlighted region in FIG. 9A.

FIG. 10A is a side elevation view of a mold used to form the shoe cover of FIGS. 8 and 9, whereas FIG. 10B is a front elevation view thereof and FIG. 10C is a cross-sectional elevation at section line C-C in FIG. 10A.

FIG. 11A is a side elevation view of a mold used to form the shoe cover of FIGS. 12-17, whereas FIG. 11B is a front elevation view thereof and FIG. 11C is a cross-sectional elevation at section line C-C in FIG. 11A.

DETAILED DESCRIPTION

Figures 1A, 1B:
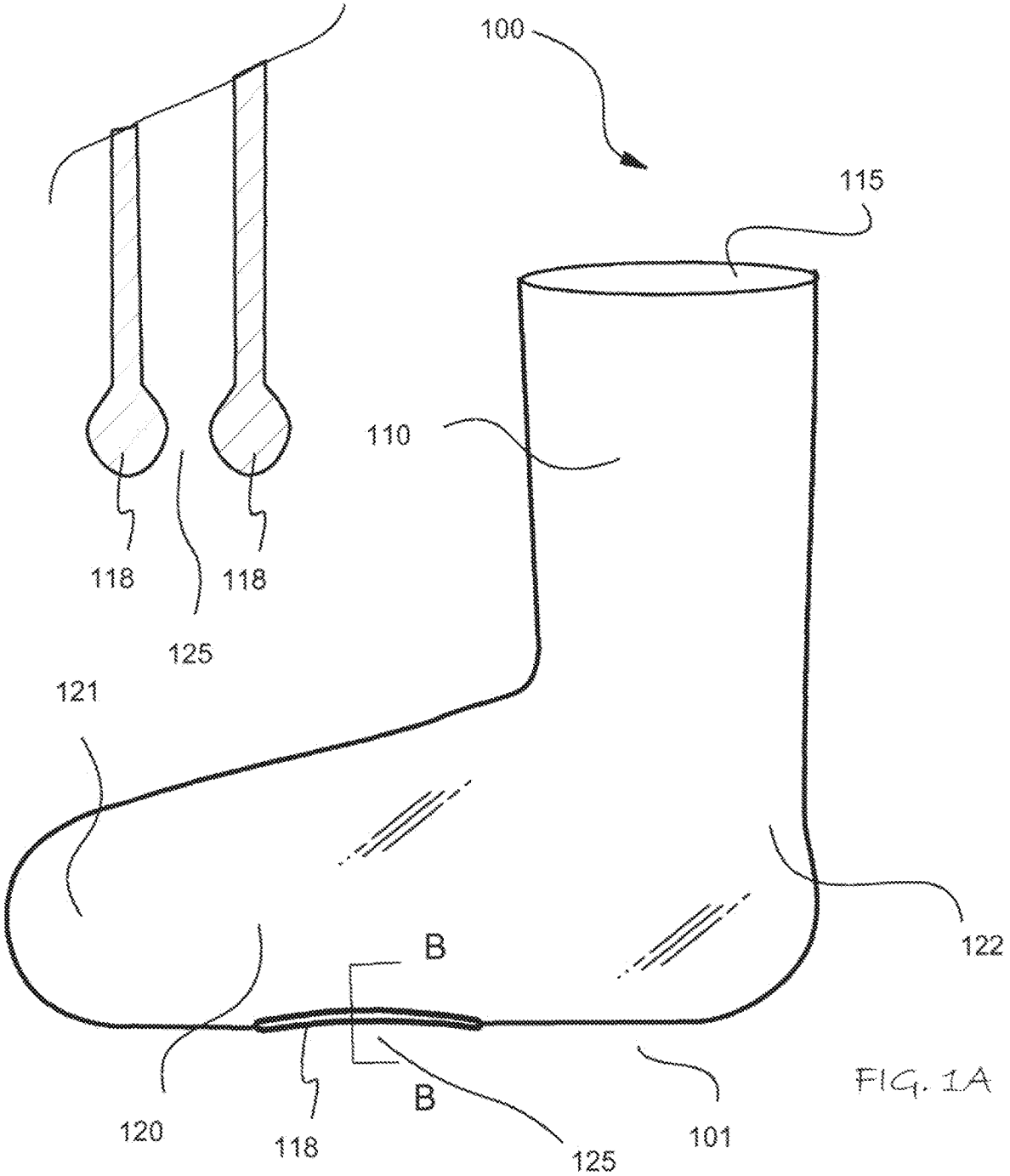
Figure 2:
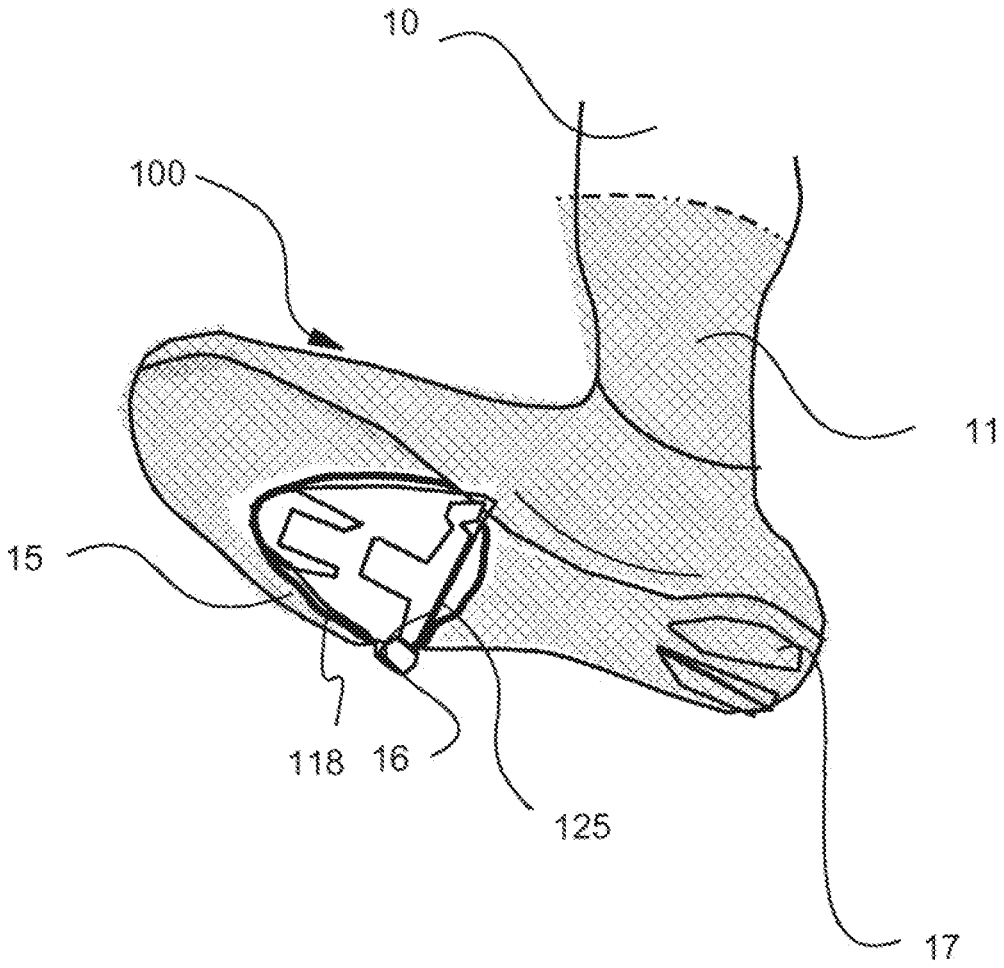
FIG. 2 is a perspective view showing the shoe cover of FIG. 1 installed over a cycling shoe, with the extent of the shoe cover illustrated by a mesh pattern.

Referring to FIGS. 1 through 17, wherein like reference numerals refer to like components in the various views, there is illustrated therein a new and improved All Weather Cycling Shoe Cover, generally denominated 100 herein.

In accordance with the present invention, the All Weather Cycling Shoe Cover is a generally sock shaped elastic member 100 for protecting the shoe and foot of a cyclist from exposure to cold temperature, water, snow, mud and road debris. It is formed as a unitary thin elastic member from a waterproof material, such as natural rubber, natural rubber blends, latex rubber, synthetic rubber, polyisoprene, polychloroprene rubber (NEOPRENE®), nitrile rubber, butyl rubber, silicone rubber, polyvinyl chloride, polyurethane, and the like.

In one embodiment of the invention, the sock like member 100 has a generally tubular shape when opened and elastically expanded by a shoe or foot and ankle that are wider than the sock like member 100. The sock like shape of shoe cover 100 is generally formed by a first generally cylindrically shaped tube member 110 having an opening 115 at the proximal end that is disposed orthogonal to a primary axis of the first generally cylindrically shaped tube member 110, and a second tubular member 120 is closed at a distal end 121 (for receiving the toe end of a shoe) connected in sealed engagement at the proximal end to the distal end of the first generally cylindrically shaped tube member 110. First generally cylindrically shaped tube member 110 is designed to snugly fit around the cyclist's upper ankle. The second tubular member is sloped downward from the intersection with the first generally cylindrically shaped tube member to snugly accommodate a shoe. The second tubular member 120 has at least one generally elliptical opening 125 around a lower or outer side portion thereof, which is on the opposing side of the shoe cover 100 from the first opening 115. Second opening 125 also may be referred to as an opening 125, as a bottom opening 125 (since it extends in the bottom of the second tubular member), and/or as a first bottom opening 125.

As the shoe cover 100 is intended to stretch over a user's 10 shoe 15 to provide a tight seal, the sock like member 100 need not have a full 3-dimensional pseudo or anatomical foot or shoe shape. Hence, the reference to the parts of the cover having a generally cylindrical or tubular shape should not be considered limiting, but merely exemplary, as alternative shapes in the general form of a foot, but smaller than the intended user's foot and shoe dimensions, will provide similar benefits.

Figure 4:
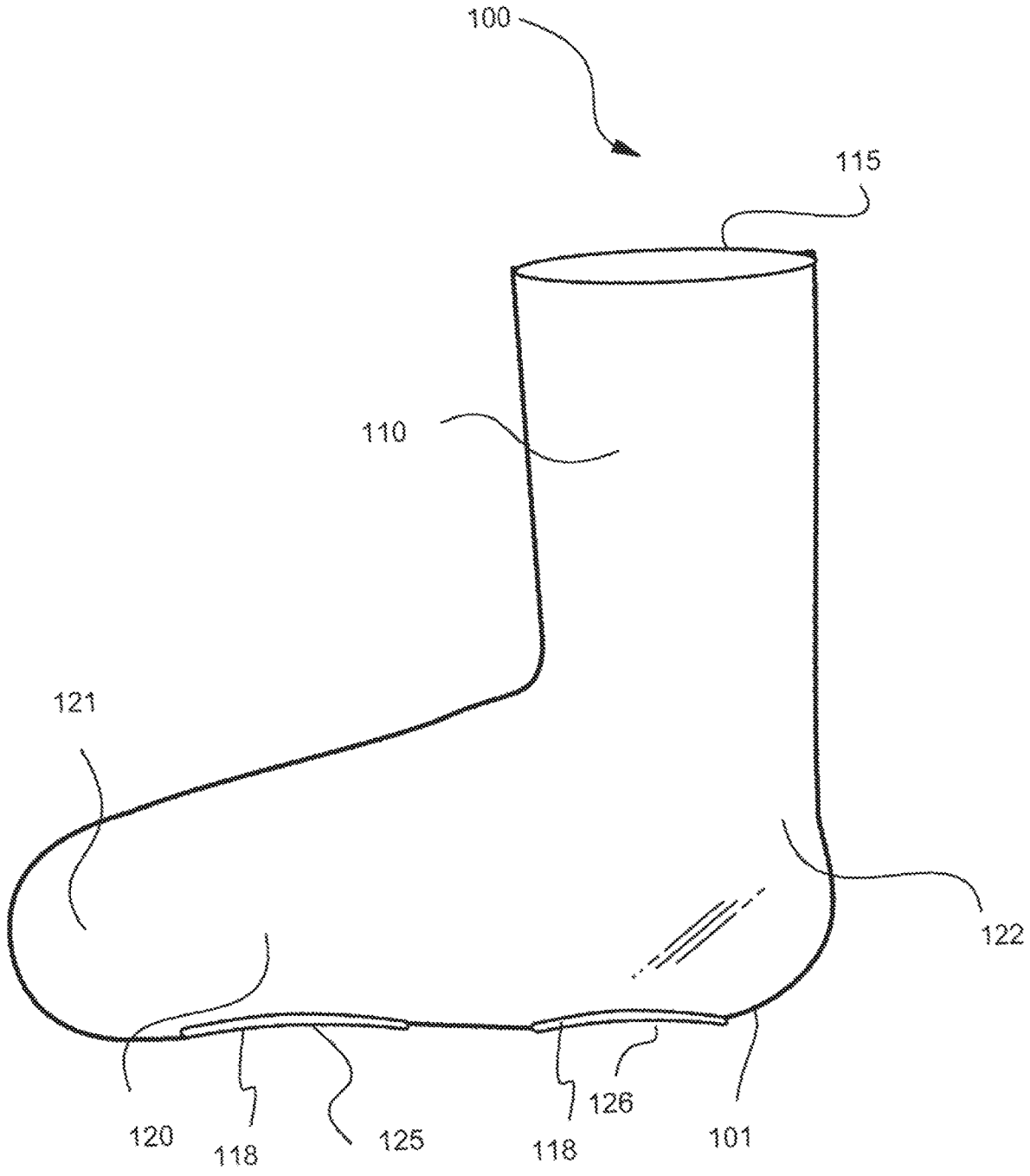
FIG. 4 is a top plan view of another embodiment of the inventive shoe cover disposed in a relaxed configuration on a flat surface.

In a second embodiment of the invention shown in FIG. 4, the sock like member 100 includes a second generally elliptical opening 126 disposed on the bottom between a proximal end 122 of the second tubular member 120 and first generally elliptical opening 125. As shown, the bottom surface of the second waterproof tubular portion of the sock like member 100 is free from additional openings other than the first bottom opening 125 and the second bottom opening 126. The aperture or first generally elliptical opening 125 in FIG. 5 accommodates the cleat 16 that extends downward from the toe of the shoe, while the heel piece 17 extends through the second generally elliptical opening 126, shown in FIG. 5.

FIG. 3A-3B illustrates the process of forming the shoe cover sock like member 100 using a generally planar sock shaped die 300. The dimensions shown in FIG. 3A are in mm and are intended to be merely exemplary, and non-limiting. A face 310 of the die 300 is preferably flat, with all edges 311 rounded, preferably at a radius that is half the thickness of the die forming plate, which is preferably about ¼ inch (about 6-7 mm). The bottom of the die 300 that would correspond to the placement of the first generally elliptical opening 125 has a protuberance or extension 330 along an axis that is parallel to the cylindrical axis of what will become the first generally cylindrically shaped tube member 110, but extending in the opposite direction. The die 300 is held by this protuberance 330, as for example via the holes shown therein when dipped in an elastomer forming liquid, such as for example a concentrated solution of either latex or other elastic polymers, or a monomer, pre-polymer or other oligomeric liquid or mixture. A thin liquid coating will remain on die 300 upon removal and draining of excess liquid. Then, upon solidification of this liquid coating, such as upon drying to remove solvent, or alternatively the curing and cross-linking of the monomer, pre-polymer or other oligomer in the elastomer forming liquid, a thin elastic coating is formed on the die 300 having the general shape of a sock 100. It should be appreciated that the same die shape can be deployed when the liquid elastomer forming liquid is applied to the surface thereof by spray coating, curtain coating and the like.

After application and curing or otherwise sufficient solidification of the liquid elastomer forming compound on the outer surface of the die 300, the sock 100 is slit at positions 340 and optionally 350 to create a thicker perimeter around the generally elliptical openings 125 and 126. The portion 355 between slit position 350 and the intended bottom of outer side 101 of the sock 100 is rolled over itself to form a thicker edge or band 118 at the perimeter of the first generally elliptical opening 125 defined by protuberance 330. Slitting can occur after removal from die 300. However, in a more preferred embodiment of the invention, the perimeter of each generally elliptical opening 125 and 126 is considerably thicker than the elastic material that forms the body of the sock like member 100. When the sock like shoe cover 100 is formed of latex rubber, the thickness over the surface thereof distal from the first generally elliptical opening 125 is preferably about 0.2 mm to about 0.4 mm, with the thicker edge or band 118 at the first generally elliptical opening and/or second generally elliptical opening 126 preferably having a circular cross-section with a diameter of about 3 mm to about 5 mm, and more preferably about 4 mm. Preferably, heat is used to further cure the latex, and the slitting is carried out while the latex is hot to enable self adhesion and/or residual curing to complete the reactions necessary to form a strong and coherent thicker edge or band 118 upon rolling the portion between slit position 355 and the bottom of outer side 101.

Figure 5:
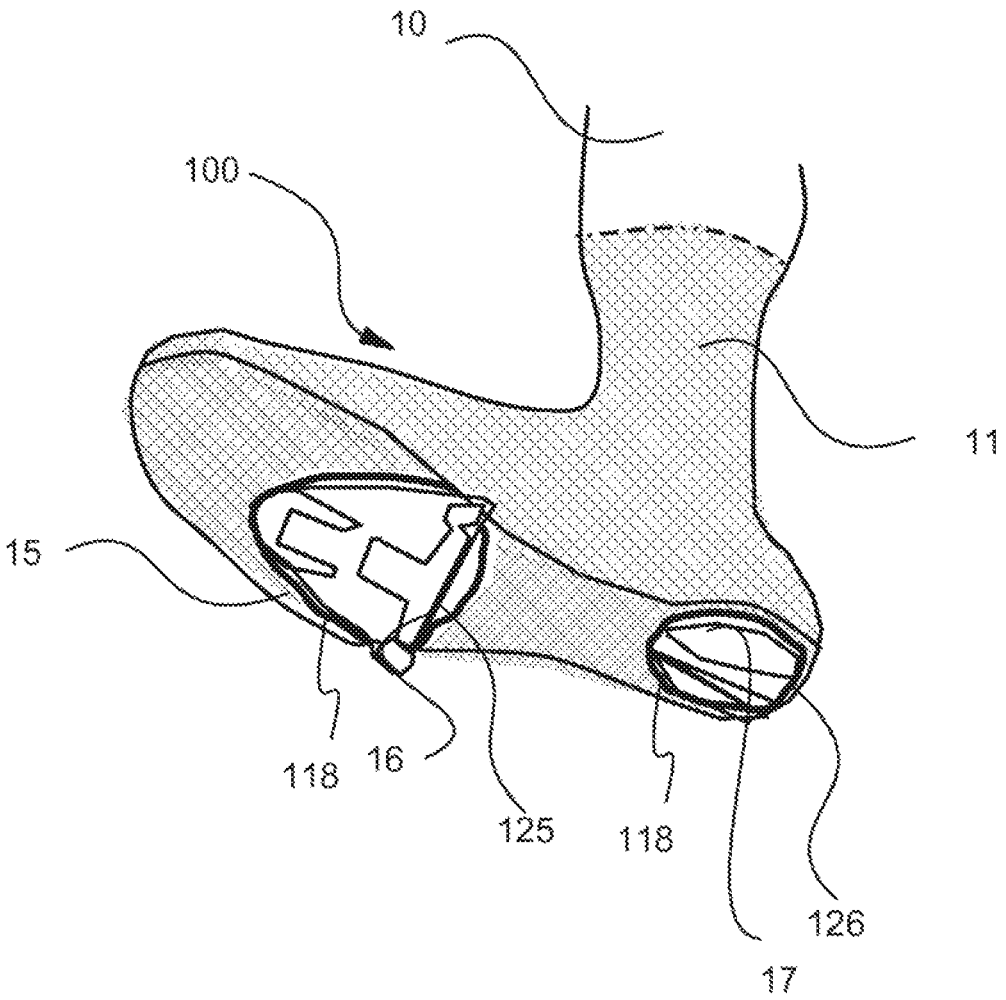
FIG. 5 is a perspective view showing the shoe cover of FIG. 4 installed over a cycling shoe, with the extent of the shoe cover illustrated by a mesh pattern.

In the embodiment shown in FIGS. 6A-C, the die 300 has a first and second protuberance 330 and 332 to form the generally elliptical hole or slit 125 and 126 respectively of the shoe cover shown in FIGS. 4 and 5. Edge 118 of generally elliptical opening 126 is similarly formed by rolling a portion 365 formed on the second die protuberance 332. It should be understood that either or both of holes 125 and 126 can optionally be circular and need not have a perfect elliptical shape, as the term elliptical is used to generally embrace rectangular holes with rounded comers or a slit with rounded sides. However, to the extent that the intended hole or slit 126 is not intended to stretch significantly on opening, the opening 126 may be formed without the use of protuberance 332, deploying for example die 300 of FIG. 3, and slitting the lower bottom surface of outer side 101 after molding.

Figure 7:
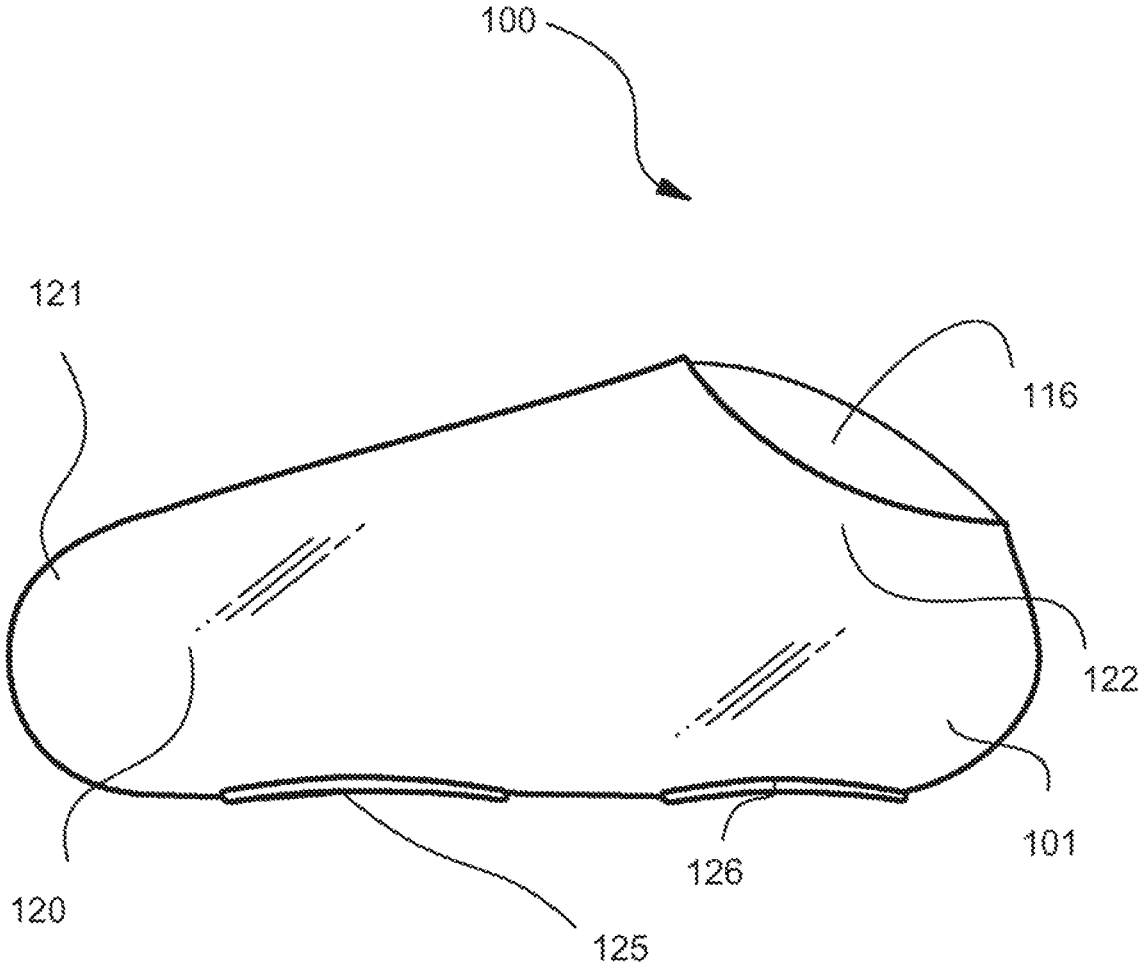
FIG. 7 is a top plan view of another embodiment of the inventive shoe cover disposed in a relaxed configuration on a flat surface.
Figure 8:
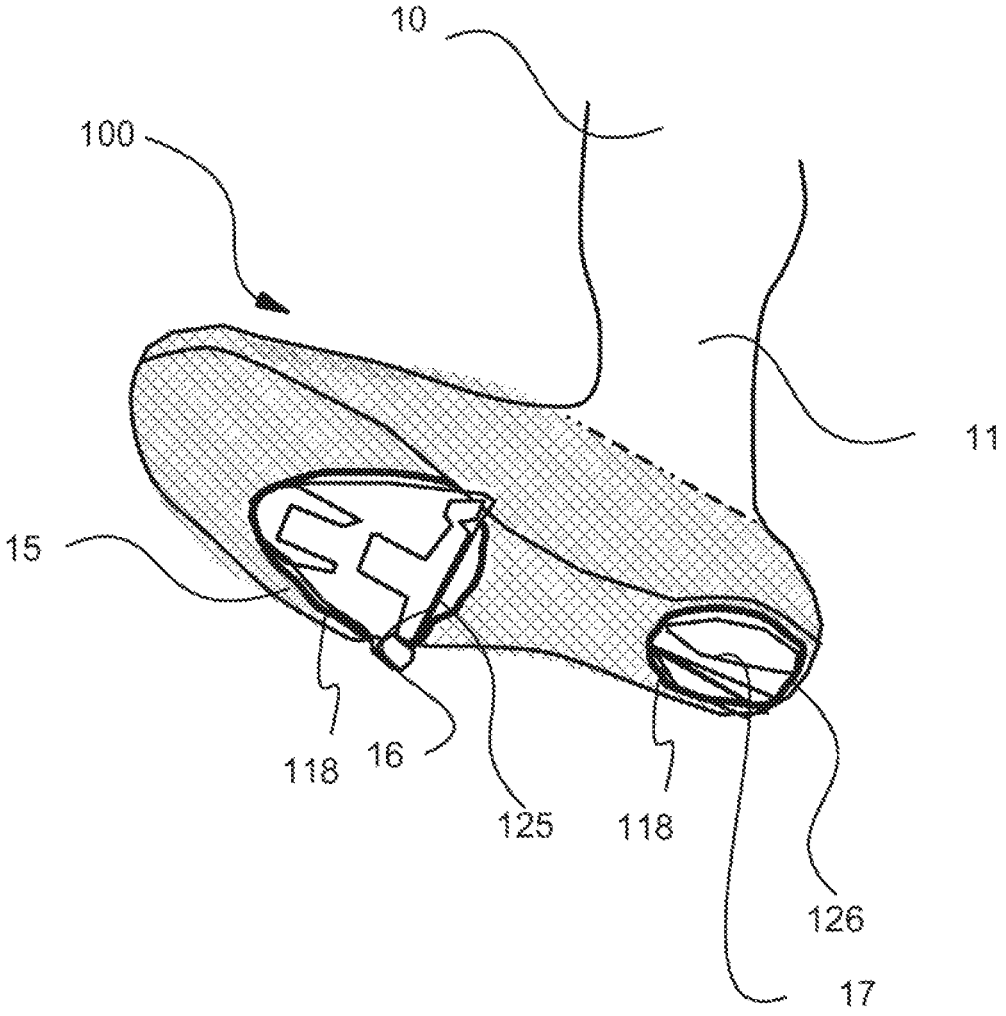
FIG. 8 is a perspective view showing the shoe cover of FIG. 7 installed over a cycling shoe, with the extent of the shoe cover illustrated by a mesh pattern.

In FIG. 7, the shoe cover 100 is formed by slitting the freshly cast preform after removal from the die 300 at reference line 340' (FIG. 6A), generally removing a significant portion of the first generally cylindrically shaped tube member 110 and placing an upper opening 116 at an acute angle across the primary axis of the second tubular member 120. FIG. 8 illustrates the expanded cover 100 of FIG. 7 installed to cover the shoe 15 of the user 10, in which a sock 13 is now exposed both above the shoe 15 and the shoe cover 100. The embodiment of FIG. 7 can be installed over the shoe after the user is wearing the shoe.

Figures 9A, 9B:
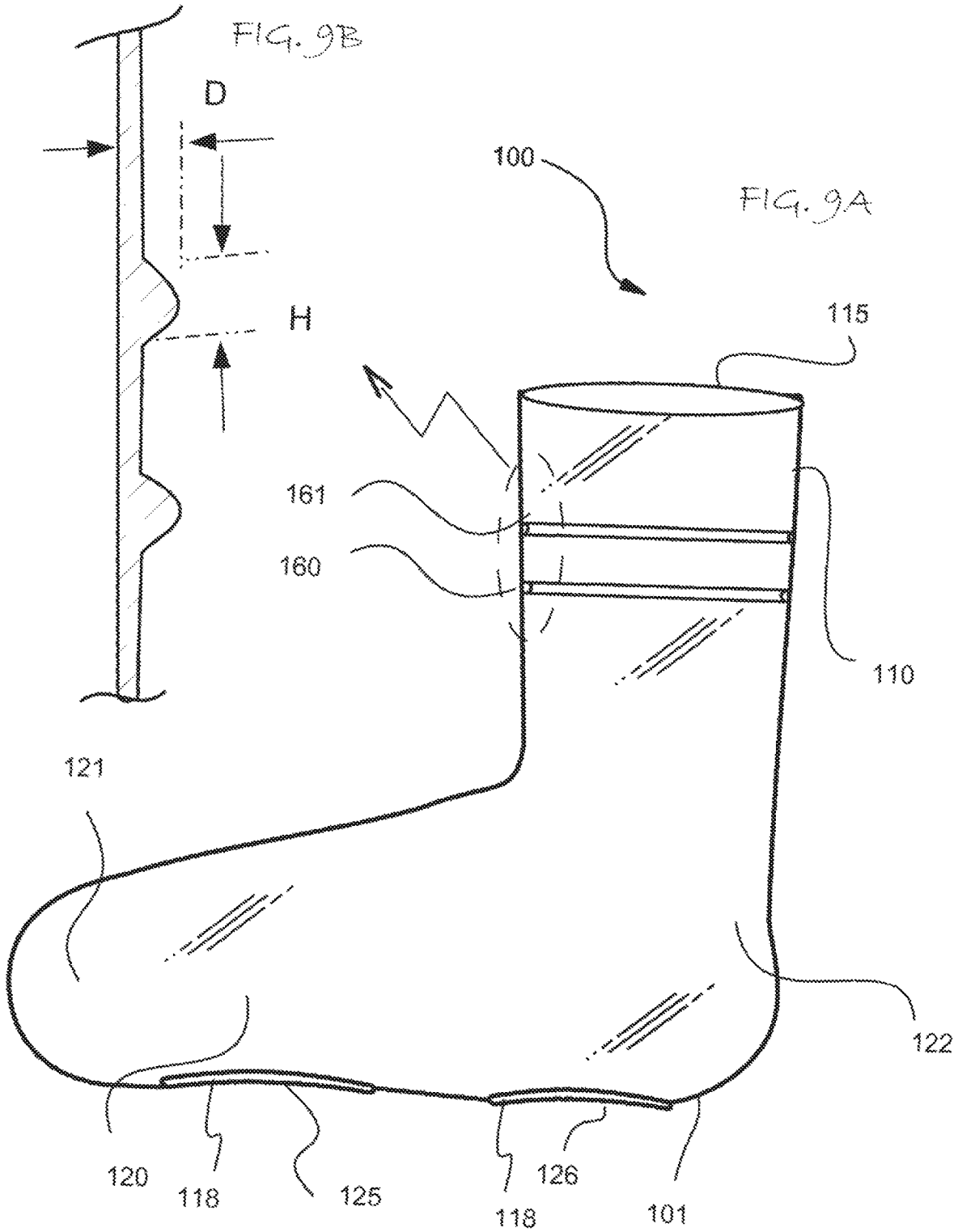
Figures 10A, 10B, 10C:
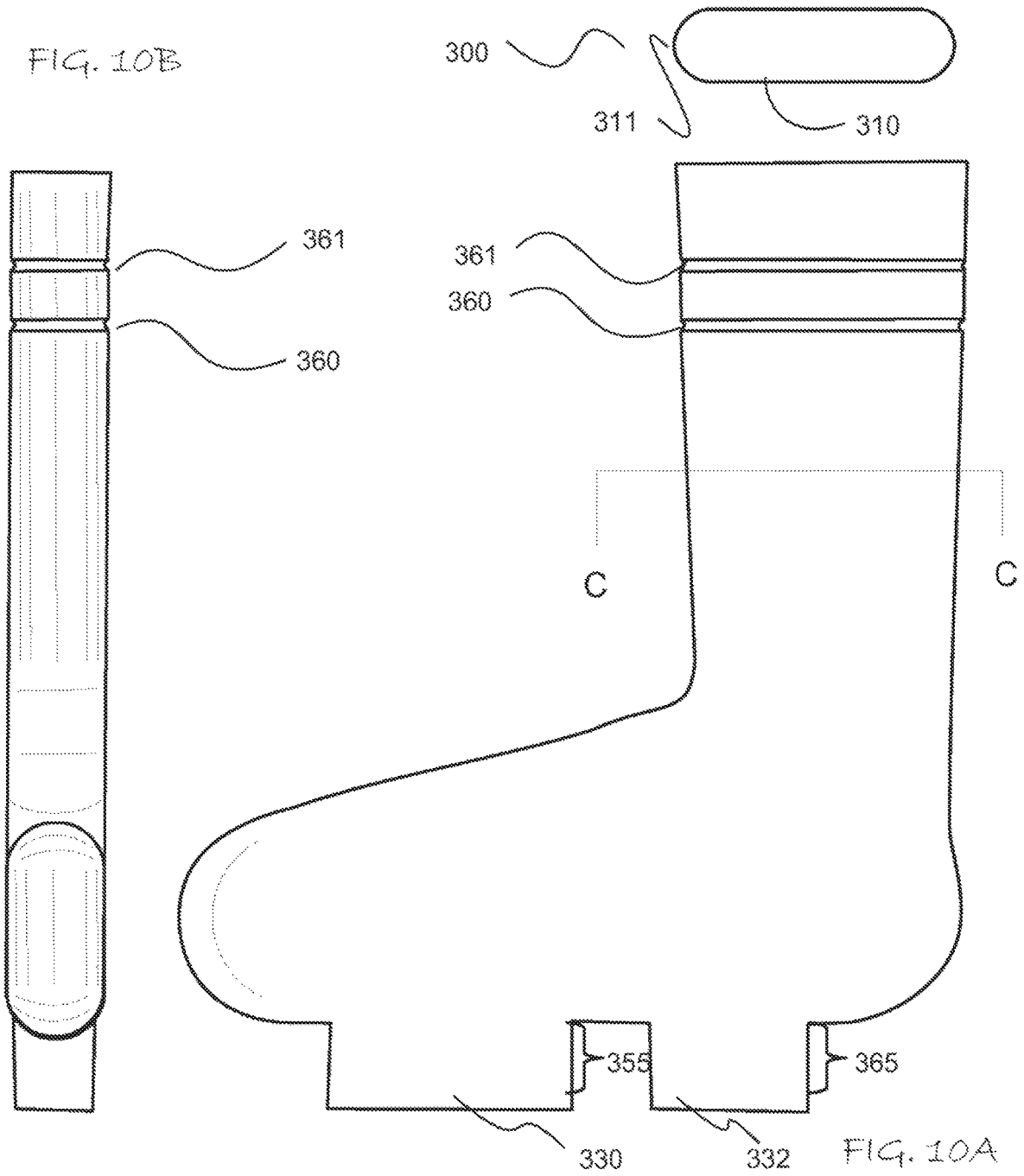

In a more preferred embodiment of the invention, illustrated with the aid of FIGS. 9A, 9B and FIG. 10, the die 300 in FIG. 10 has a series of two or more spaced apart and indented annular channels 360 and 361 around what will become the first generally cylindrically shaped tube member 110 of the sock 100. As the channels 360 and 361 will tend to retain more elastomer forming liquid compound on coating the die 300, due to surface tension, upon extraction from die 300 filled annular channels will replicate into a pair of spaced apart annular bands or flange 160 and 161 on the corresponding portion of the sock like shoe cover member 100 as shown in the embodiment in FIGS. 9A and 9B. Then, upon installation on an ankle 11 of the user 10, these bands 160 and 161, will form a tighter sealing surface by concentrating a compressive stress in a narrow region on the user's leg/ankle 11 or sock 13 to further preclude water egress in harsher conditions. As shown in FIGS. 9A and 9B, these bands 160 and 161 preferably have a height (H) of about 2-4 mm and a depth (D) of about 1.0 to about 1.5 mm. They are also preferably separated from each other by about 5 to 20 mm, and more preferably by about 10 mm, and are also preferably disposed about 5 to 20 mm, but more preferably about 10 mm, from the top of the sock like shoe cover 100.

In FIGS. 11A-C, the die 300 has a single large protuberance 330 that is intended to form a lower generally elliptical opening 125 in the bottom of the sock like shoe cover 100 shown in FIGS. 12-17.

Figure 12:
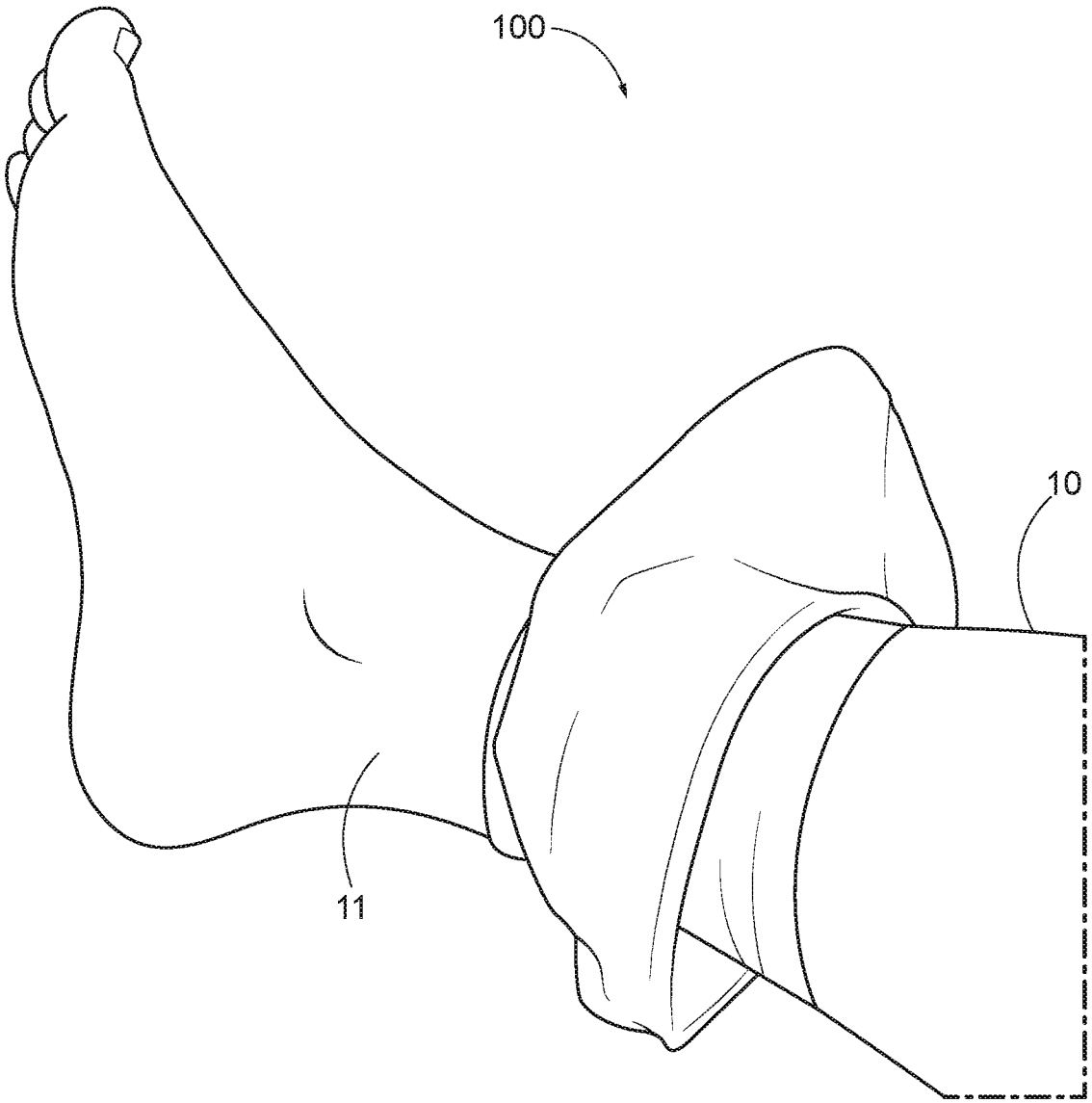
FIGS. 12, 13, 14 and 15 illustrate consecutive steps of a user installing the shoe cover constructed using the mold illustrated in FIGS. 11A-C, with the extent of the shoe cover illustrated by a mesh pattern.
Figure 13:
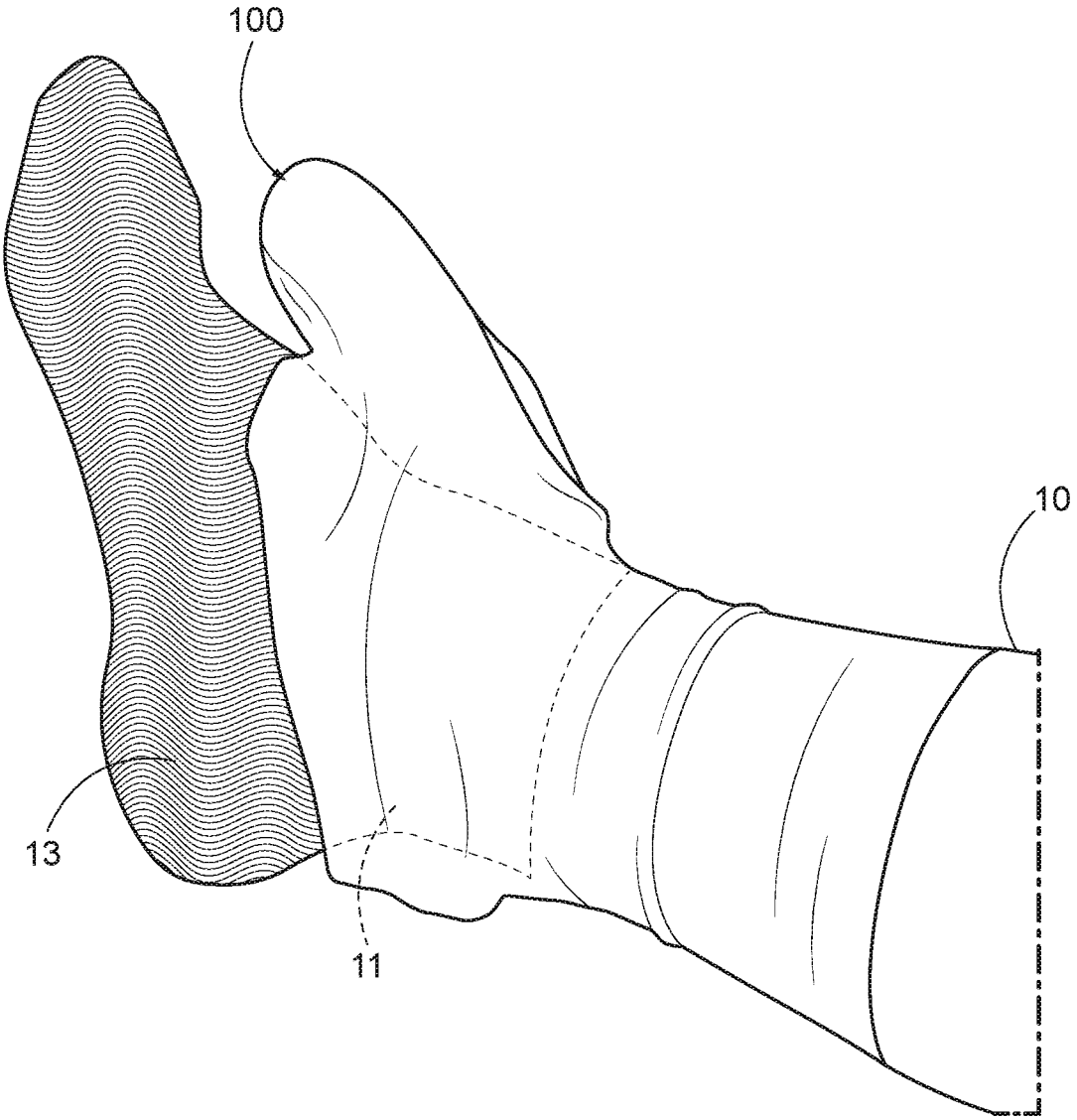
Figure 14:
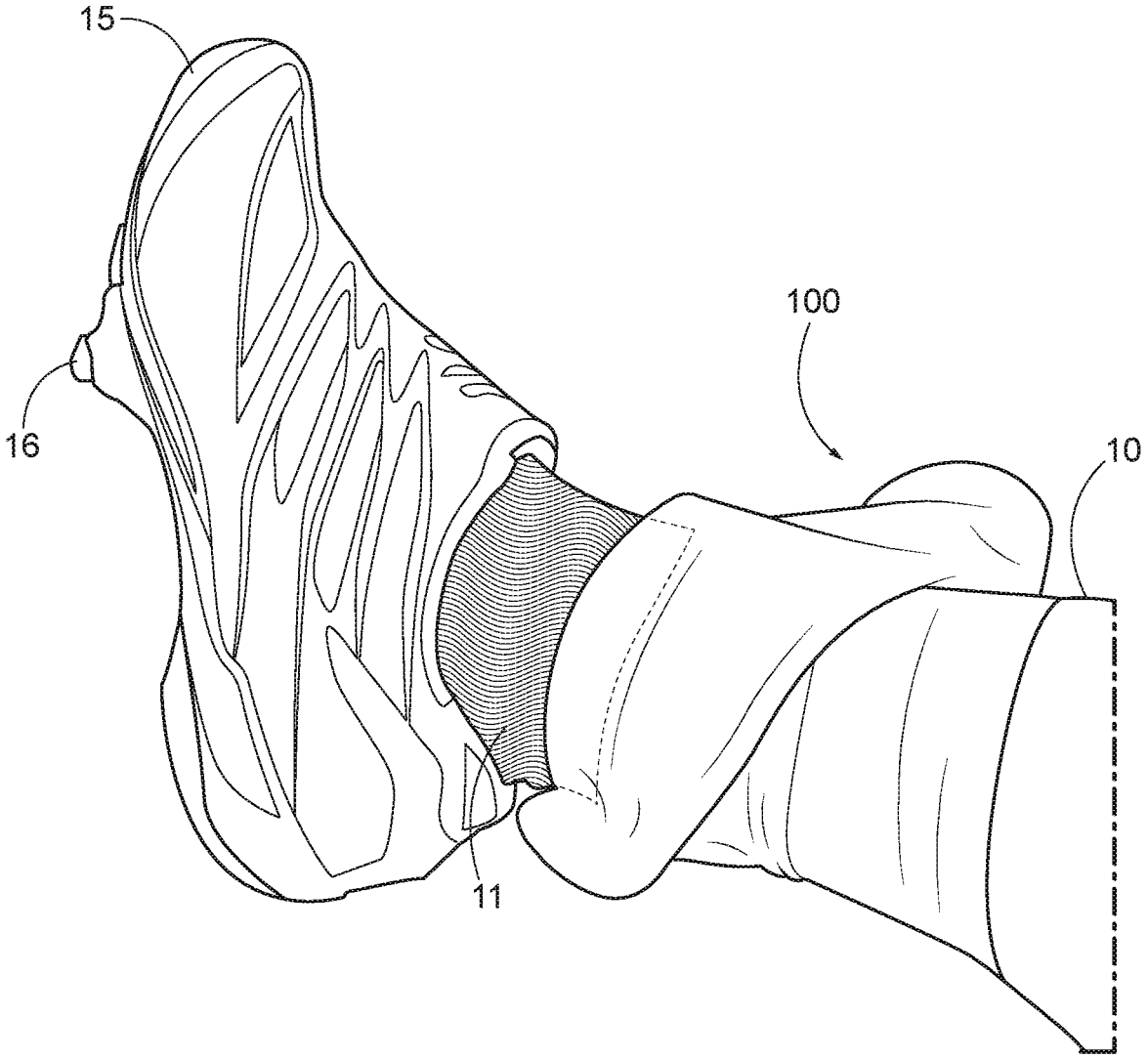
Figure 15:
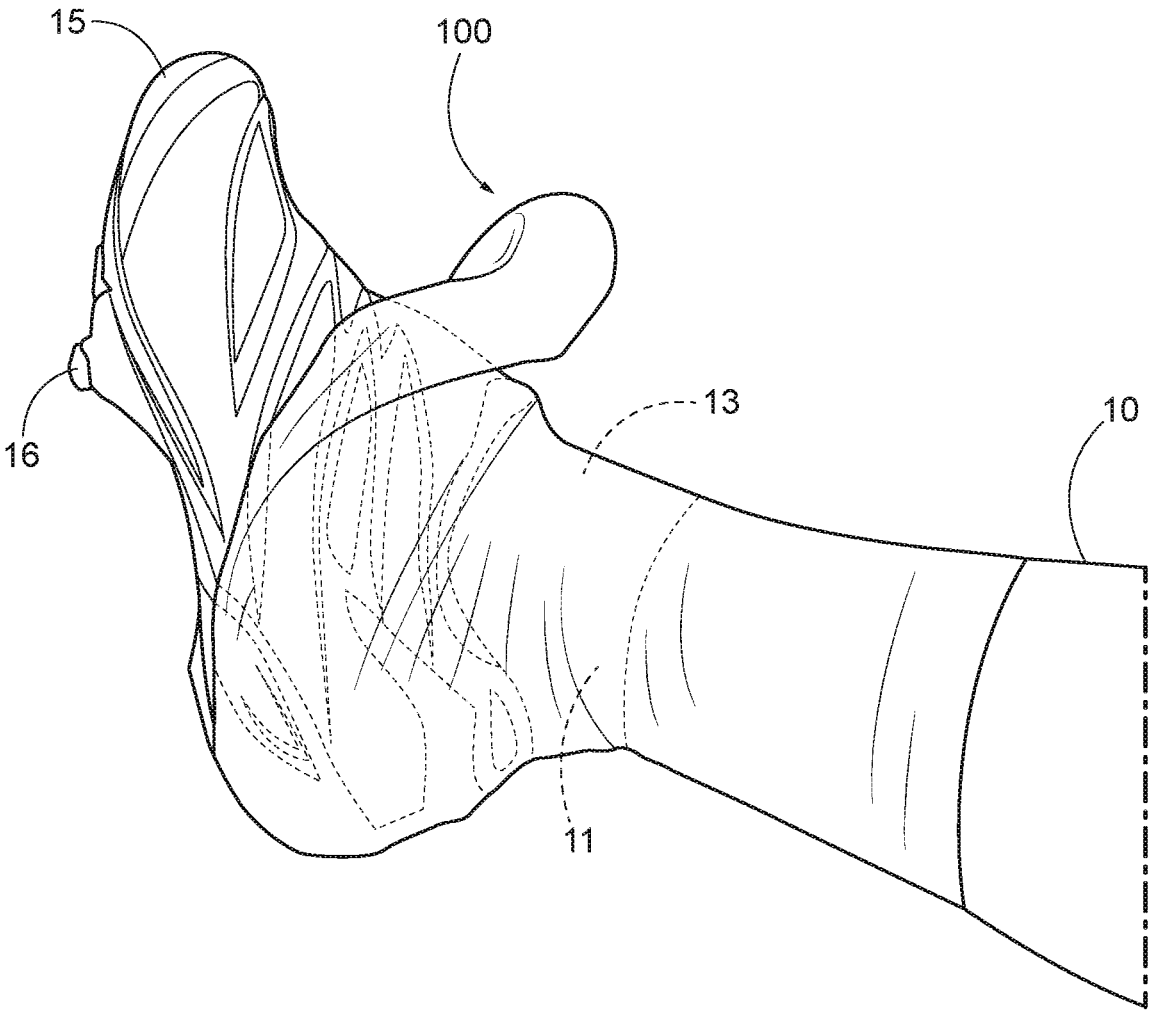
Figure 16:
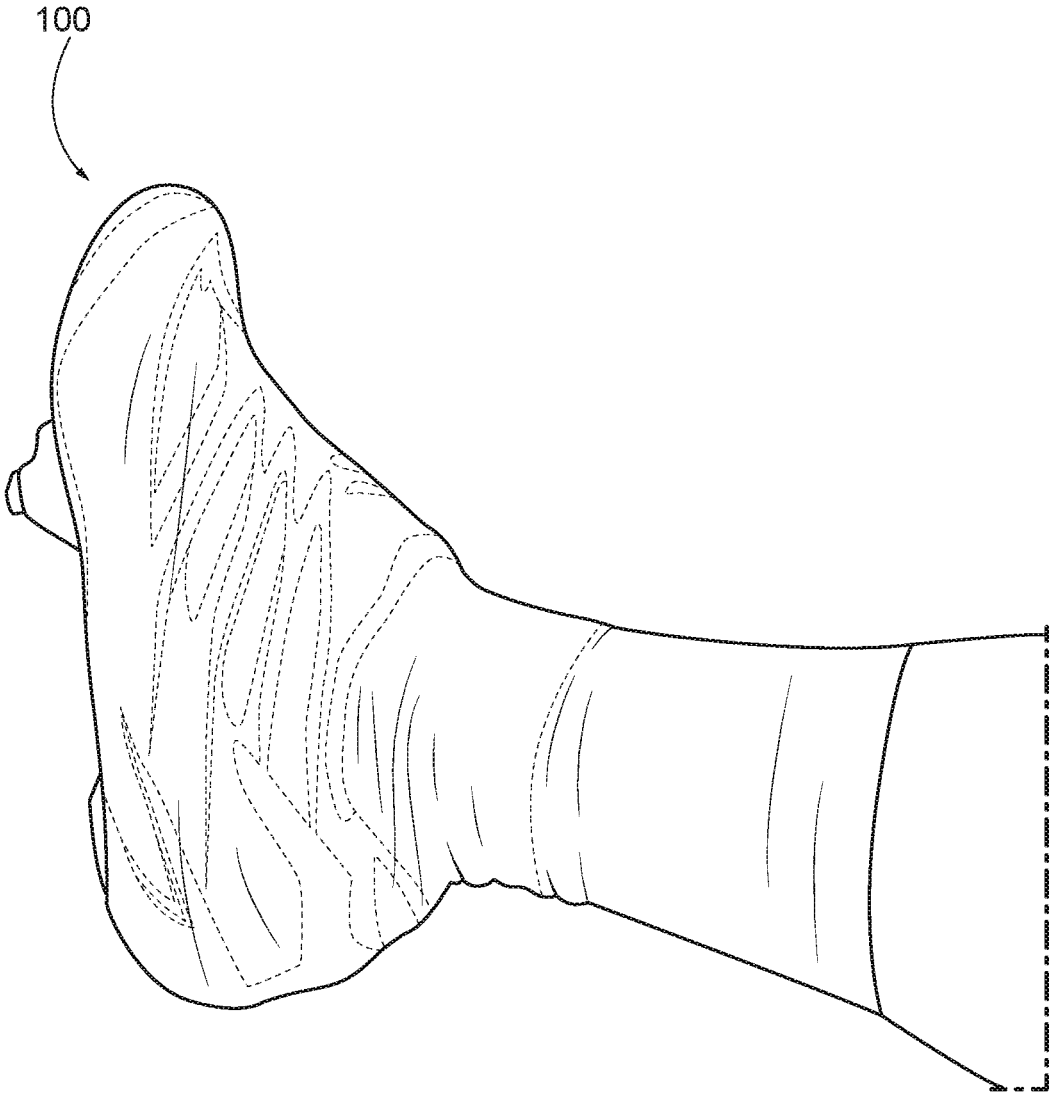
FIG. 16 is a first perspective view of the installed shoe cover constructed using the mold illustrated in FIGS. 11A-C, with the extent of the shoe cover illustrated by a mesh pattern.
Figure 17:
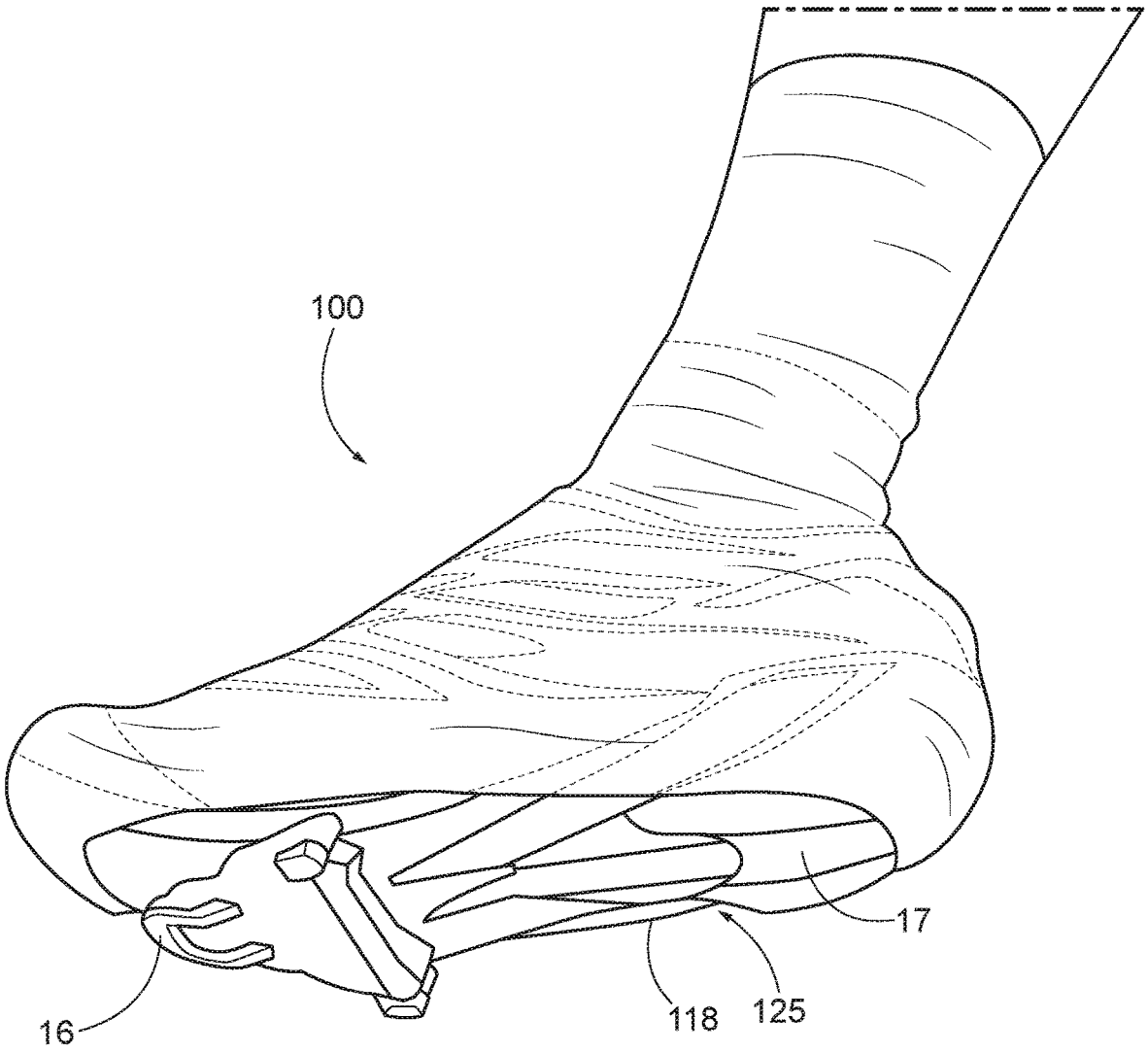
FIG. 17 is a first perspective view of the installed shoe cover constructed using the mold illustrated in FIGS. 11A-C, with the extent of the shoe cover illustrated by a mesh pattern.

It should now be appreciated that the sock like shoe cover of the various embodiments, is preferably placed on the ankle to form a water tight seal before or after socks are worn. Thus, as shown in FIG. 12, the user 10 first places the shoe cover 100 over the ankle 11, then puts on the sock 13, as shown in FIG. 13, and cycling shoe 15 in FIG. 14, and finally in FIG. 15 pulls the shoe cover 100 over the shoe 15 from above. The shoe cover 100 is flipped over the shoe and cradles the edge of the sole by about 1 cm all around to provide a secure fit. Thus, when the shoe cover 100 is donned on the cycling footwear, the bottom opening 125 is configured to be spaced inward from the edge of the sole by about 1 cm all around the edge of the sole. Described in slightly different terms, when the shoe cover 100 is donned on the cycling footwear, the perimeter of the bottom opening 125 is configured to be spaced inward from the edge of the sole by about 1 cm all around the edge of the sole. Because the shoe cover 100 will not be in contact with the cleat 16 so that no part of the cleat 16 is covered by the shoe cover 100, it will not interfere with the engagement of the cleat 16 and a pedal of a bicycle. The aperture or opening 125 in FIG. 17 accommodates both the cleat 16, and the heel piece 17.

It should now be appreciated that the inventive shoe cover 100 uniquely and inventively departs from prior art design by enabling a "top-down" installation, which covers the entire shoe from above with a single piece of material. This ensures a tight seal around the ankle and the entire upper surface of the shoe, providing maximum water, snow, and wind resistance.

It should be understood that the shoe cover 100 is intended to stretch at least about 20 to 30% of the original length to form a snug fit at the user's 10 ankle or calf 11. However, the elastomer forming the shoe cover 100 should also be able to stretch without tearing, undergoing permanent deformation or strain hardening when stretched by at least about 40% to about 80%, and preferably at least 60% to fit over the shoe and retain a tight seal at the ankle 11 by remaining stretched to about 15 to 30%, and more preferably at least about 20%, on the user's calf and ankle above the shoe 15. However, the shoe cover 100 is also preferably sized so that once installed on the shoe it has preferably stretched at least about 20 to 30% at each hole or aperture in the sole portion and to both reduce water egress into the shoe from above and slippage of the cover during cycling.

For example, a well fitted shoe cover 100 will stretch about 60% at the portion that extends over the toe, and 80% to extend over the heel. Then upon fitting over the shoe 15, the elastic material while relaxing is still stretched preferably about 20 to 30% at the apertures 125 or 126 on the bottom or sole portion of the outer side 101.

If the shoe cover 100 needs to be removed from the shoe while the cleat is engaged with the pedal, the cyclist can simply tear the cover off and discard it. Whereas discarding a "bottom-up" shoe cover would be prohibitively expensive, discarding the "top-down" shoe cover (the present invention) would be economically feasible because the cover is made of a single-mold piece of inexpensive elastomer, such as latex rubber. In contrast, with the "bottom-up" shoe cover, the cyclist has to disengage the pedal from the cleat in order to remove the cover, which can be dangerous.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A waterproof sock shaped unitary tubular member formed from an elastic waterproof material for covering cycling footwear having a sole with a bottom, an edge that extends around a perimeter of the bottom of the sole, and a cleat that projects from the bottom of the sole, the waterproof sock shaped unitary tubular member comprising:

a first waterproof tubular portion having an upper opening defined at a proximal end of the first waterproof tubular portion, and a distal end opposite the proximal end, the upper opening being configured to receive an ankle and a heel of a foot of a person through the upper opening; and a second waterproof tubular portion closed at a second tubular portion distal end and connected in waterproof sealed unitary engagement at a second tubular portion proximal end to the distal end of the first waterproof tubular portion, the second waterproof tubular portion having a bottom surface that is opposite the upper opening of the first waterproof tubular portion and is configured to correspond to and cradle the edge of the sole of the cycling footwear when the waterproof sock shaped unitary tubular member is donned on the cycling footwear; wherein the bottom surface of the second waterproof tubular portion defines a bottom opening that is configured to receive the cleat of the cycling footwear through the bottom opening when the waterproof sock shaped unitary tubular member is donned on the cycling footwear; wherein when the waterproof sock shaped unitary tubular member is donned on the cycling footwear, the bottom surface of the second waterproof tubular portion is configured to extend interior of the edge by about 1 cm all around the edge of the sole; and wherein the second waterproof tubular portion is configured to correspond to and seal against the bottom of the sole of the cycling footwear when the waterproof sock shaped unitary tubular member is donned on the cycling footwear.

2. The waterproof sock shaped unitary tubular member of claim 1, wherein when the waterproof sock shaped unitary tubular member is donned on the cycling footwear, the bottom opening is configured to be spaced inward from the edge by about 1 cm all around the edge of the sole.

3. The waterproof sock shaped unitary tubular member of claim 1, wherein the bottom opening has a perimeter, and further wherein when the waterproof sock shaped unitary tubular member is donned on the cycling footwear, the perimeter of the bottom opening is configured to be spaced inward from the edge by about 1 cm all around the edge of the sole.

4. The waterproof sock shaped unitary tubular member of claim 1, wherein the bottom surface of the second waterproof tubular portion is configured not to contact the cleat when the waterproof sock shaped unitary tubular member is donned on the cycling footwear.

5. The waterproof sock shaped unitary tubular member of claim 1, wherein the bottom opening has a perimeter that is configured to be spaced apart from the cleat when the waterproof sock shaped unitary tubular member is donned on the cycling footwear.

6. The waterproof sock shaped unitary tubular member of claim 1, wherein the bottom opening is a bottom elliptical opening when the second waterproof tubular portion is in a relaxed configuration.

7. The waterproof sock shaped unitary tubular member of claim 1, wherein the bottom opening is a first bottom opening, wherein the waterproof sock shaped unitary tubular member further comprises a second bottom opening defined in the bottom surface of the second waterproof tubular portion, wherein the second bottom opening is configured to expose a portion of a heel of the cycling footwear when the waterproof sock shaped unitary tubular member is donned on the cycling footwear; and further wherein the bottom surface of the second waterproof tubular portion is free from additional openings other than the first bottom opening and the second bottom opening.

8. The waterproof sock shaped unitary tubular member of claim 7, wherein the second bottom opening is spaced apart from the first bottom opening on the bottom surface of the second waterproof tubular portion.

9. The waterproof sock shaped unitary tubular member of claim 7, wherein when the second waterproof tubular portion is in a relaxed configuration, the second bottom opening has an elliptical configuration.

10. The waterproof sock shaped unitary tubular member of claim 7, wherein when the second waterproof tubular portion is in a relaxed configuration, the second bottom opening is smaller in size than the first bottom opening.

11. The waterproof sock shaped unitary tubular member of claim 7, wherein the elastic waterproof material has a portion of greater thickness along a perimeter of the first bottom opening than on portions distal the first bottom opening, and further wherein the portion of greater thickness along the perimeter of the first bottom opening is a continuous bead.

12. The waterproof sock shaped unitary tubular member of claim 11, wherein the continuous bead comprises a rolled up portion of the elastic waterproof material.

13. The waterproof sock shaped unitary tubular member of claim 12, wherein the rolled up portion of the elastic waterproof material forming the continuous bead is a rolled up self-adhered portion of the elastic waterproof material.

14. The waterproof sock shaped unitary tubular member of claim 12, wherein the elastic waterproof material is a latex containing rubber with a thickness of 0.2 mm to 0.4 mm, and further wherein the continuous bead along the perimeter of the first bottom opening has a diameter of 3 mm to 5 mm.

15. The waterproof sock shaped unitary tubular member of claim 1, wherein the second waterproof tubular portion is sloped downward from the first waterproof tubular portion.

16. A kit, comprising:

a cycling footwear; and the waterproof sock shaped unitary tubular member of claim 1 donned on the cycling footwear.

17. A method of donning the waterproof sock shaped unitary tubular member of claim 1 over the cycling footwear, the method comprising the steps of:

a) inserting the foot and the ankle of the person through the upper opening defined in the first waterproof tubular portion of the waterproof sock shaped unitary tubular member;

b) further inserting the foot into the second tubular portion of the waterproof sock shaped unitary tubular member;

c) still further inserting the foot completely through the bottom opening defined in the bottom surface of the second waterproof tubular portion;

d) after the still further inserting, donning the cycling footwear on the foot while the foot is exterior of the bottom opening;

e) after the donning the cycling footwear, pulling the second tubular portion proximal end over a heel of the cycling footwear; and f) after the donning the cycling footwear, pulling the second tubular portion distal end over a toe portion of the cycling footwear and receiving the cleat of the cycling footwear through the bottom opening.

18. The method of claim 17, further comprising, after step f), positioning the bottom opening so that no part of the cleat of the cycling footwear is covered by the bottom surface of the second waterproof tubular portion.

19. The method of claim 17, wherein the bottom surface further comprises a second bottom opening, and wherein after step e), the method further comprises positioning the second bottom opening defined in the bottom surface over the heel of the cycling footwear.

20. The method of claim 17, further comprising, after step f), positioning the proximal end of the first waterproof tubular portion above a proximal end of a sock worn by the person.

* * * * *